US009009938B2

(12) United States Patent
Noyes

(10) Patent No.: US 9,009,938 B2
(45) Date of Patent: Apr. 21, 2015

(54) TOOL FOR REMOVING FROM OR JOINING TOGETHER A BEARING AND A HUB

(76) Inventor: Rusty J. Noyes, Bellgrade, MT (US)

( * ) Notice: Subject to any disclaimer, the term of this patent is extended or adjusted under 35 U.S.C. 154(b) by 1278 days.

(21) Appl. No.: 12/767,054

(22) Filed: Apr. 26, 2010

(65) Prior Publication Data

US 2010/0269321 A1 Oct. 28, 2010

Related U.S. Application Data

(60) Provisional application No. 61/214,464, filed on Apr. 24, 2009.

(51) Int. Cl.
*B25B 27/14* (2006.01)
*B25B 27/02* (2006.01)

(52) U.S. Cl.
CPC ..... *B25B 27/02* (2013.01)

(58) Field of Classification Search
CPC ..... B25B 27/02
USPC ..... 29/255, 275, 282, 254, 263, 258, 243, 29/518; 264/99, 100; 254/99, 100
See application file for complete search history.

(56) References Cited

U.S. PATENT DOCUMENTS

| | | | | |
|---|---|---|---|---|
| 2,779,089 | A * | 1/1957 | Allen | 29/254 |
| 2,971,254 | A * | 2/1961 | Fairfield | 29/261 |
| 3,003,230 | A * | 10/1961 | Fornes | 29/254 |
| 3,106,012 | A * | 10/1963 | Comer | 29/254 |
| 3,662,451 | A * | 5/1972 | Wagner | 29/237 |
| 3,875,644 | A | 4/1975 | Simpson | |
| 4,283,827 | A * | 8/1981 | Abel | 29/254 |
| 4,284,387 | A * | 8/1981 | Ferris | 416/134 A |
| 4,507,838 | A * | 4/1985 | Hacker | 29/263 |
| 4,729,157 | A * | 3/1988 | McCue | 29/426.5 |
| 4,936,003 | A * | 6/1990 | Gloe | 29/254 |
| 5,210,918 | A * | 5/1993 | Wozniak et al. | 29/254 |

(Continued)

FOREIGN PATENT DOCUMENTS

| | | | |
|---|---|---|---|
| JP | 2001-277148 | A | 10/2001 |
| KR | 20-0116834 | Y1 | 6/1998 |

(Continued)

OTHER PUBLICATIONS

International Searching Authority—PCT—Notification of Transmittal of the International Search Report and the Written Opinion of the International Searching Authority, or the Declaration. (PCT/US2010/032432).

*Primary Examiner* — Peter DungBa Vo
*Assistant Examiner* — Kaying Kue
(74) *Attorney, Agent, or Firm* — Hamilton IP Law, PC; Jay R. Hamilton; Charles A. Damschen

(57) ABSTRACT

A tool for removing a spindle and/or elastomeric bearing from a hub generally includes a coupler, an arm, and a weight slidably engaged with the arm. The weight is slidable with respect to the arm along a predetermined stroke that limits the travel of the weight. The coupler may be secured to a spindle, which spindle is in turn secured to a bearing, or the coupler may be secured directly to the bearing. An operator may slide the weight between a first position adjacent the coupler and a second position opposite the coupler to impart kinetic energy to the spindle and/or bearing, thereby removing the bearing from or the bearing installing into a hub, depending on whether the kinetic energy is in an inboard or outboard direction.

7 Claims, 9 Drawing Sheets

(56) References Cited

U.S. PATENT DOCUMENTS

| | | | | |
|---|---|---|---|---|
| 5,322,415 | A | 6/1994 | White et al. | |
| 5,613,288 | A * | 3/1997 | Lundsten | 29/255 |
| 5,848,460 | A * | 12/1998 | Rasmussen et al. | 29/263 |
| 6,036,442 | A * | 3/2000 | Certain et al. | 416/143 |
| 6,088,898 | A * | 7/2000 | Lundsten | 29/255 |
| 6,536,088 | B1 * | 3/2003 | Chiang | 29/255 |
| 6,971,149 | B2 * | 12/2005 | Berman et al. | 29/254 |
| 7,001,255 | B2 * | 2/2006 | Ploeger et al. | 451/115 |
| 7,530,790 | B2 * | 5/2009 | Cabrera et al. | 416/134 A |
| 8,038,394 | B2 * | 10/2011 | Stille et al. | 416/1 |
| 8,069,544 | B2 * | 12/2011 | Sollami | 29/254 |
| 2005/0079056 | A1 | 4/2005 | Welsh | |
| 2005/0081352 | A1 * | 4/2005 | Gargiulo | 29/254 |
| 2009/0180882 | A1 * | 7/2009 | Stille et al. | 416/140 |
| 2010/0048370 | A1 * | 2/2010 | Sollami | 483/65 |

FOREIGN PATENT DOCUMENTS

| | | | |
|---|---|---|---|
| KR | 20-0125671 | Y1 | 2/1999 |
| KR | 10-2002-0080711 | A | 10/2002 |

* cited by examiner

TOOL FOR REMOVING FROM OR JOINING TOGETHER A BEARING AND A HUB

CROSS REFERENCE TO RELATED APPLICATIONS

Applicant states that this utility patent application claims priority from provisional U.S. Pat. App. No. 61/214,464 filed on Apr. 24, 2009, which is incorporated by reference herein in its entirety.

FIELD OF THE INVENTION

The present invention relates to a tool for removing from or joining together two objects. More specifically, the embodiments pictured herein are especially useful for assembling or disassembling a spindle and hub.

STATEMENT REGARDING FEDERALLY SPONSORED RESEARCH OR DEVELOPMENT

No federal funds were used to create or develop the invention herein.

REFERENCE TO SEQUENCE LISTING, A TABLE, OR A COMPUTER PROGRAM LISTING COMPACT DISK APPENDIX

Not Applicable

BACKGROUND OF THE INVENTION

For many years now Sikorsky has designed and built safe reliable aircraft for our service men and women around the world. The H-60 and other similar aircraft are relatively new helicopters, which Sikorsky and others are constantly improving with respect to features, safety, support equipment, and maintenance. For example, U.S. Pat. No. 5,322,415, which is incorporated by reference herein in its entirety, discloses a pitch actuation restrain device that may be used with the H-60 and other Sikorsky helicopters.

The safety of the H-60 and any other aircraft during operation is highly dependent on proper maintenance. Many maintenance schedules for helicopters require that, at minimum, the spindles be removed from the main rotor hub annually. However, close tolerances between the elastomeric bearing (to which the spindle is secured) and rotor hub make spindle removal and installation very difficult. Many helicopters are four-blade designs, meaning each helicopter includes four spindles each. Using traditional methods, the removal or installation of just one spindle may require two or three maintenance personnel working for 24 hours, for a total of 48-72 man hours.

The traditional methods that maintenance personnel have learned and developed involve inherent risks as a consequence of a desire to minimize aircraft downtime. Maintenance workers often scrape or polish paint and primer off of opposing surfaces of the rotor hub and bearing because of the difficulty of installation of the spindles. Furthermore, maintenance workers often fail to apply sealant between these opposing surfaces and instead apply sealant only to the exterior seam between the bearing and hub. The absence of sealant between the opposing surfaces somewhat mitigates the difficulty of spindle removal, but decreases rotor hub and bearing life due to increased corrosion (which may be a dissimilar metal corrosion depending on materials of construction) between the opposing surfaces of these components.

Maintenance personnel have permanently damaged $130,000 rotor hubs and/or $14,000 elastomeric bearings by attempting to pry the bearing from the rotor hub with a screwdriver, chisel, or other tool. Sometimes personnel use an over head crane at an angle relative to the longitudinal axis of the bearing to provide a means of force in the direction of spindle removal.

Such procedures have proved very dangerous due to the increased likelihood of the spindle assembly, which may weigh in excess of 150 pounds, to swing uncontrollably from the overhead crane once the spindle assembly has become dislodged from the rotor hub.

Accordingly, a need exists for a better tool and method for removing bearings from hubs, and particularly for removing elastomeric bearings from main rotor hubs of various aircraft.

SUMMARY OF THE INVENTION

The present disclosure related to a tool and method to aid in the removal from and/or installation of a bearing to a hub. The embodiments pictured herein are specifically designed to aid removal and/or installation of a spindle assembly (which is secured to an elastomeric bearing) from a main rotor hub of a helicopter.

The tool and method allow maintenance personnel to use proper corrosion preventative primer, paint, and sealant on the opposing surfaces. The tool and method allows personnel to use the manufacturer recommended procedures during spindle assembly removal and installation. This would decrease corrosion between the bearing and rotor hub and eliminate damage to rotor hubs and bearings caused by prying tools. The present tool and method would also save countless man hours and aircraft downtime due to increased efficiency. Additionally, the present tool and method virtually eliminate the likelihood of maintenance personnel injury and/or death during spindle removal and installation.

Universal in its design, the tool may be configured to bolt directly to the spindle (such as the case with the Sea Hawk) or the bearing bolt plate. In the case of pinned-type blades, such as those found on the Sikorsky Black Hawk, the coupler of the tool pins directly to the spindle. A weight may be reciprocated about a handle secured to the coupler to transmit mechanical energy to the spindle and/or bearing. The mechanical energy the tool transmits to the spindle and/or bearing is parallel to the direction the spindle and/or bearing must travel to be removed from or installed in the rotor hub.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION—ELEMENT LISTING

Figure 1:
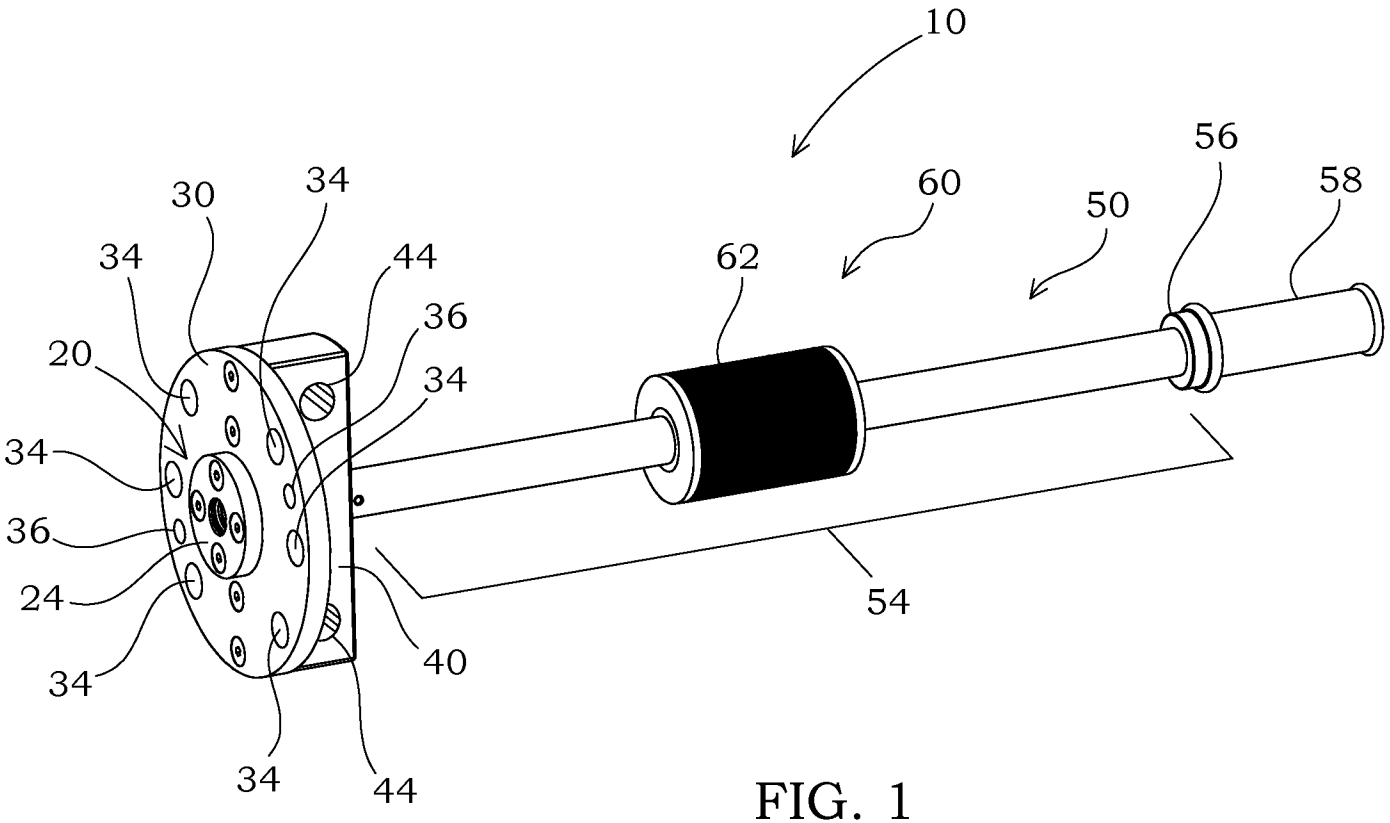
FIG. 1 is a perspective view of one embodiment of the tool.

| Description | Element No. |
|---|---|
| Tool | 10 |
| Nut | 12 |
| Bolt | 14 |
| Bolt aperture | 16 |
| Threaded aperture | 17 |
| Hub | 18 |
| Connector | 20 |
| Connector tube | 22 |
| Connector base | 24 |
| Plate coupler | 30 |
| Connector aperture | 32 |
| Plate aperture | 34 |
| Alignment aperture | 36 |
| Block coupler | 40 |
| Pin aperture | 44 |
| Pin | 46 |
| Arm | 50 |
| Connector engagement member | 52 |
| Stroke | 54 |
| Limiter | 56 |
| Handle | 58 |
| Weight | 60 |
| Grip | 62 |
| Arm aperture | 64 |
| Sleeve | 66 |
| Spindle | 70 |
| Blade engagement portion | 72 |
| Spindle arm | 72a |
| Shaft | 74 |
| Bearing | 80 |
| Bearing bolt plate | 82 |
| Shoulder | 84 |
| Bearing body | 86 |

DETAILED DESCRIPTION

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance. Furthermore, any dimensions recited or called out herein are for exemplary purposes only and are not meant to limit the scope of the invention in any way unless so recited in the claims.

1. Description of Structure

Figure 2:
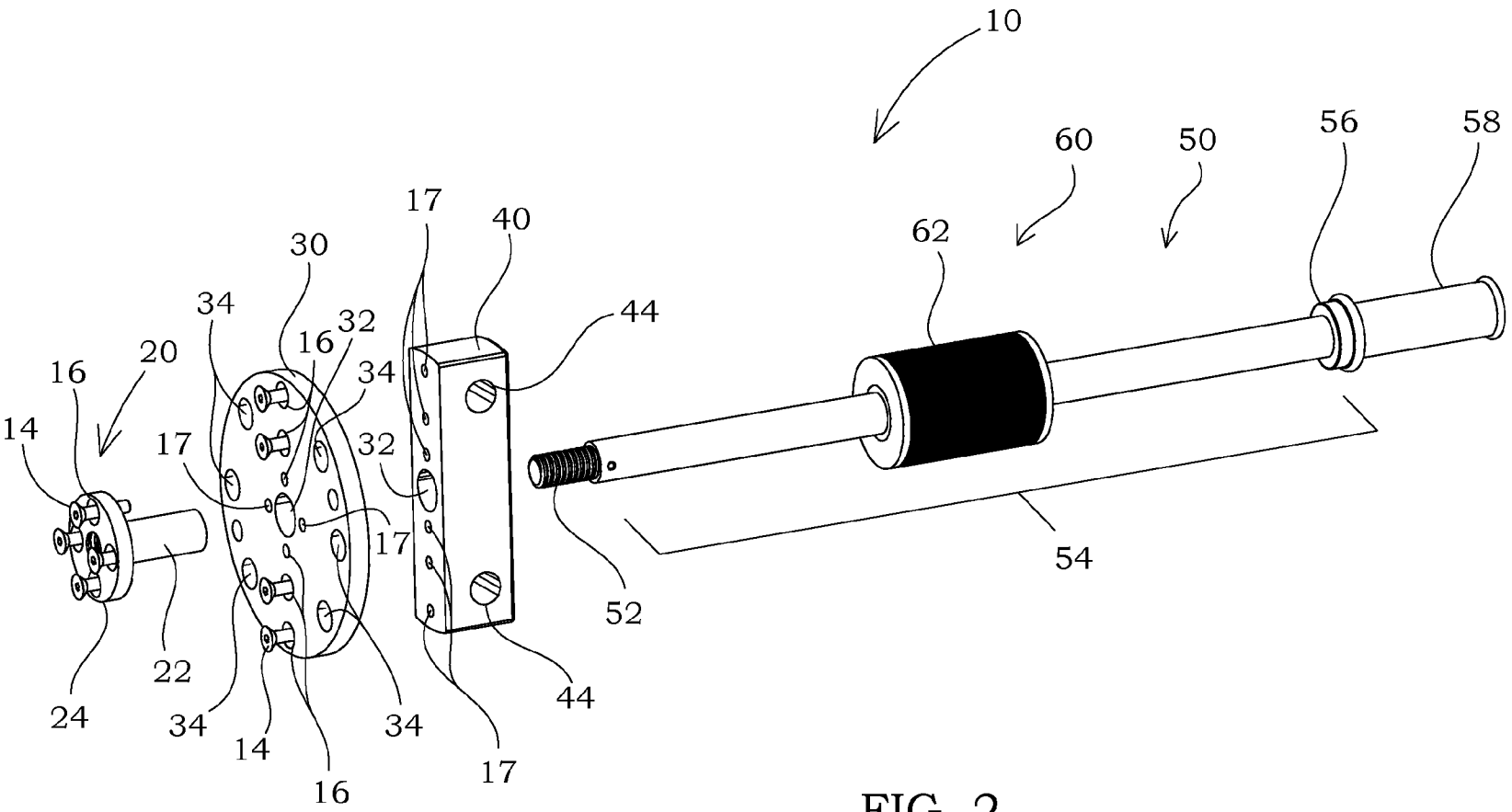
FIG. 2 is an exploded view of one embodiment of the tool.

A perspective view of one embodiment of the tool 10 is shown in FIG. 1, and FIG. 2 shows an exploded view of the same embodiment of the tool 10. Generally, the tool 10 includes an arm 50, a coupler (shown as a plate coupler 30 and/or block coupler 40 in the embodiments pictured herein), and a weight 60 slidably engaged with the arm 50.

As shown in FIG. 2, the coupler 30, 40 in the embodiment of the tool 10 pictured herein includes a plate coupler 30 and a block coupler 40. The plate coupler 30, which is shown in detail in FIG. 3, may be formed with a connector aperture 32 in the center thereof and a plurality of plate apertures 34 positioned at various locations about the plate coupler 30. The number and/or location of the various plate apertures 34 and/or connector aperture 32 will vary from one embodiment of the tool 10 to the next, and are in therefore no way limiting to the scope of the tool 10. The plate coupler 30 may also include a plurality of bolt apertures 16 and/or a plurality a threaded apertures 17, the function of which are described in detail below. The plate coupler 30 may also include a plurality of alignment apertures 36, the presence of which depends on the specific application for the tool 10. In certain applications, properly arranged alignment apertures ensure that the plate coupler 30 fits flush against the spindle 70 during use, which use is described in detail below.

In the embodiment pictured herein, the plate coupler 30 includes six plate apertures 34 arranged in two groups of three near the periphery of the plate coupler 30. Within each group of three, the plate apertures 34 are equally spaced from adjacent plate apertures 34, wherein the angle between adjacent plate apertures 34 is approximately forty five degrees. Accordingly, the angle between the outermost plate apertures 34 of the two groups is approximately ninety degrees. However, this configuration/orientation of plate apertures 34 merely serves as an illustrative example of one embodiment. In another embodiment of the tool 10 not pictured herein, eight plate apertures 34 are equally spaced about the periphery of the plate coupler 30. In still another embodiment not pictured herein, five plate apertures are unequally spaced about the periphery and interior of the plate coupler 30.

Figure 4:
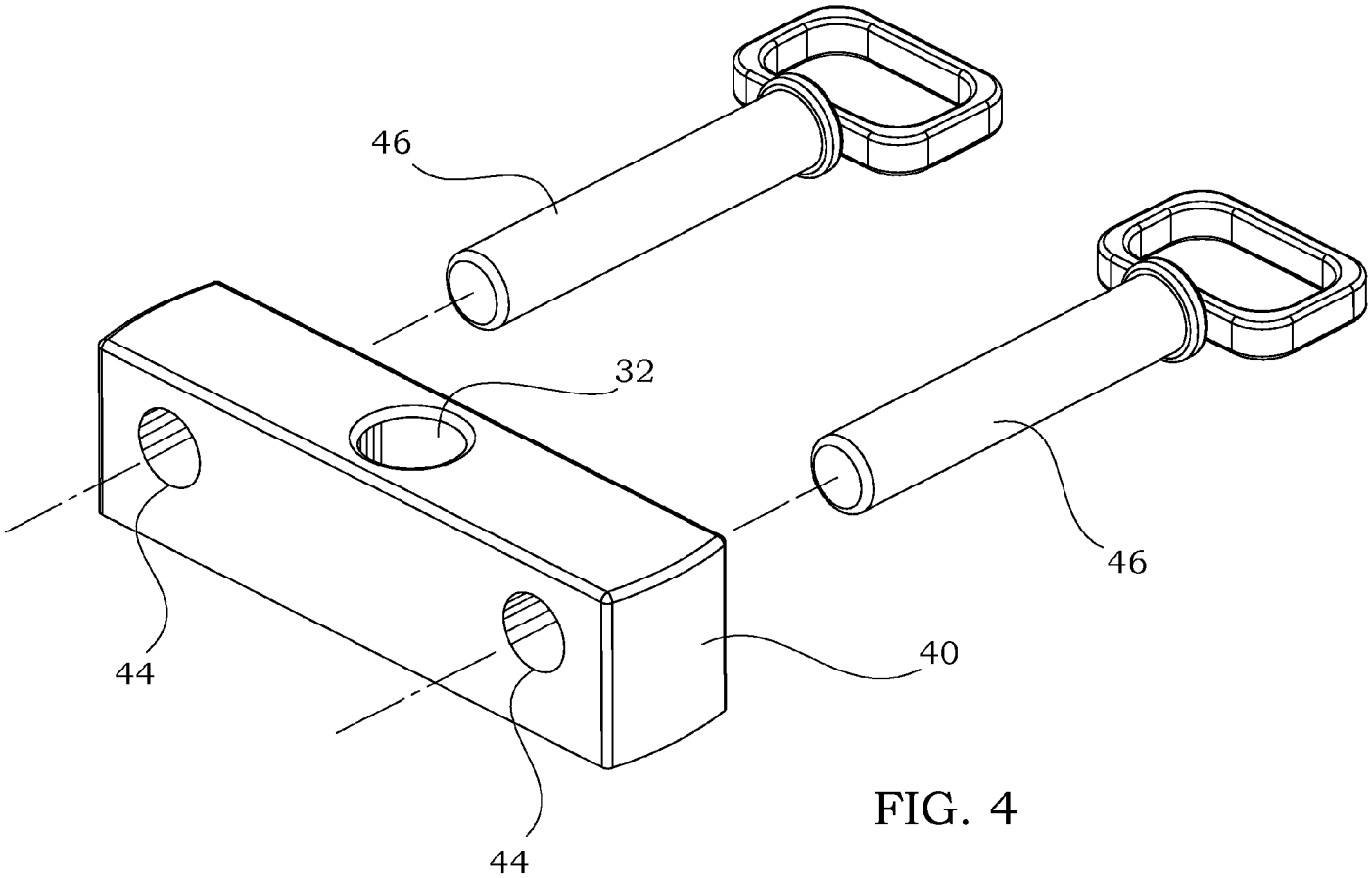
FIG. 4 is a perspective view of a second embodiment of a coupler.

The block coupler 40, which is shown in detail in FIG. 4, may be formed with a connector aperture 32 therein and a plurality of pin apertures 44. In the embodiment pictured herein, the connector aperture 32 of the block coupler 40 is positioned in lengthwise center thereof. However, the number and/or location of the connector aperture 32 and/or various pin apertures 44 will vary from one embodiment of the tool 10 to the next, and are in therefore no way limiting to the scope of the tool 10. The block coupler 40 may also include a plurality of bolt apertures 16 and/or threaded apertures 17 therein.

In the embodiment pictured herein, the block coupler 40 includes two pin apertures 44 positioned adjacent either end of the block coupler 40. The pin apertures 44 are configured such that the longitudinal axis thereof is perpendicular to that of the connector aperture 32 formed in the block coupler 40. However, this configuration/orientation of pin apertures 44 merely serves as an illustrative example of one embodiment. In another embodiment not pictured herein, the block coupler 40 is formed with a single pin aperture therein, wherein the pin aperture 44 is offset to one side of the block coupler 40.

In the embodiment of the tool pictured herein, the plate coupler 30 and block coupler 40 are secured to one another via a plurality of corresponding bolt apertures 16, threaded apertures 17, and bolts 14. As shown in FIGS. 1 and 2, four bolts 14 may be positioned so that each bolt 14 passes through a respective bolt apertures 16 in the plate coupler 30 and engages a respective threaded aperture 17 positioned in the block coupler 40. However, in other embodiments of the tool 10 not pictured herein, the plate coupler 30 and block coupler 40 are secured to one another with a different number of bolts 14, and the tool 10 is not limited by the structure and/or method for securing the plate coupler 30 to the block coupler 40. Accordingly, any structure and/or method known to those skilled in the art suitable for securing one object to another may be used to secure the plate coupler 30 to the block coupler 40 without limitation, including but not limited to screws, rivets, chemical adhesives, welds, and/or combinations thereof. In still other embodiments of the tool 10, the plate coupler 30 is not secured to the block coupler 40, which may be true for embodiments of the tool 10 wherein the plate coupler 30 and/or block coupler 40 are configured such that securing them to one another is inefficient or impractical.

The arm 50 is shown in perspective removed from other components of the tool 10 in FIG. 2. A connector engagement member 52 may be positioned at one end of the arm 50, and a handle 58 may be positioned at the opposite end thereof. The portion of the arm between the connector engagement member 52 and the handle 58 generally forms a stroke 54 for a weight 60, which is described in detail below. A limiter 56 may be positioned adjacent the connector engagement member 52 and/or handle 58 to provide the boundaries of the stroke 54. In the embodiment pictured herein, the coupler 30, 40 provides an inboard limit to the stroke 54, and the limiter 56 provides the outboard limit to the stroke 54. The handle 58 and limiter 56 as shown as separate components in the embodiment of the tool 10 pictured herein, but may be formed as one integral structure in other embodiments.

The arm 50 may be secured to the coupler 30, 40 with a connector 20. In the embodiment pictured herein, the connector is formed with a connector tube 22 and a connector base 24. The connector tube 22 and connector base 24 may be formed as separate elements and later joined together, or they may be integrally constructed with one another. The connector tube 22 passes through the connector apertures 32 in the plate coupler 30 and block coupler 40 such that the connector base 24 is positioned adjacent the plate coupler 30. The coupler base 24 may be formed with a plurality of bolt apertures 16 therein that correspond to bolt apertures 16 formed in the plate coupler 30 and threaded apertures 17 formed in the block coupler 40 and/or plate coupler 30.

Figure 3:
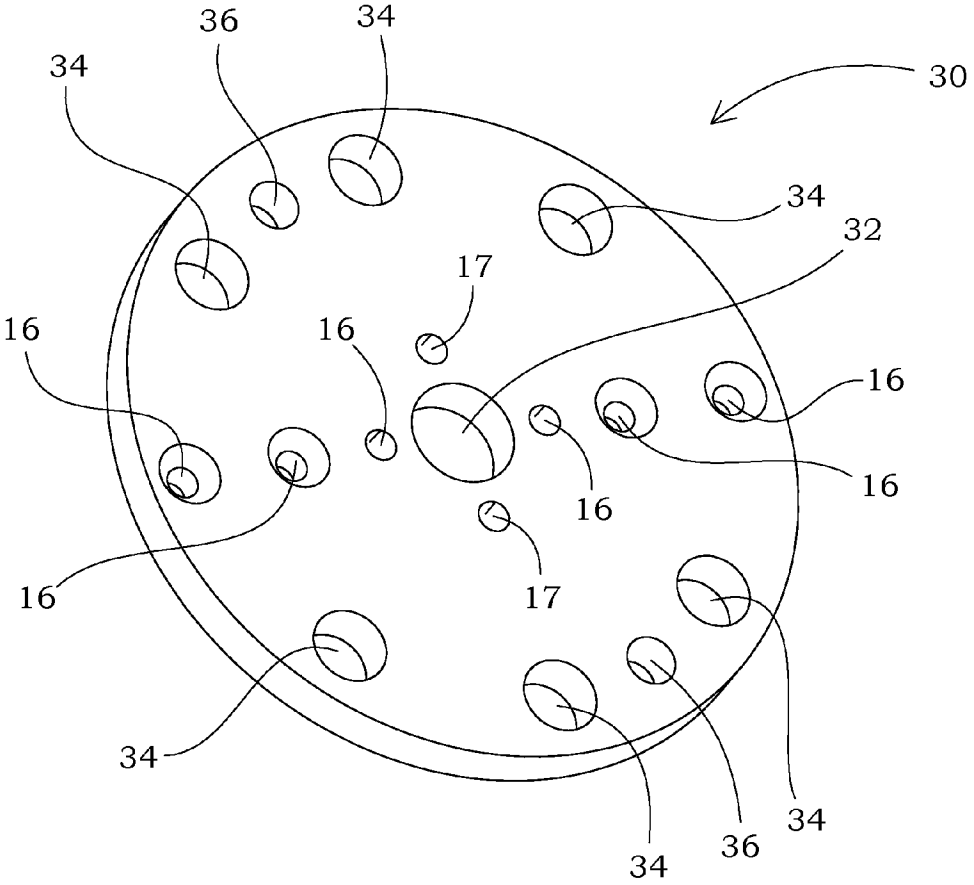
FIG. 3 is a perspective view of a first embodiment of a coupler.

The connector 20 may be secured to the plate and/or block coupler 30, 40 using corresponding bolts 14. In the embodiment shown herein, two threaded apertures 17 are arranged perpendicularly with respect to the major length of the block coupler 40 such that two bolts 14 positioned in the corresponding bolt apertures 16 in the connector base 24 may directly engage those threaded apertures 17, thereby securing the connector 20 to the plate coupler 30. Two bolt apertures 16 may be formed in the plate coupler 30 so that those bolt apertures 16 align with the block coupler 40 (as shown in FIG. 3) so that corresponding bolts 14 may be positioned to pass through the corresponding bolt apertures 16 in the connector base 24 and plate coupler 30 and engage two threaded apertures in the block coupler 40, thereby securing the connector to the block coupler 40. Simultaneously securing the connector 20 to both the plate coupler 30 and block coupler 40 allows the tool 10 to withstand more outboard force without damaging any of the components thereof because the force during use is more evenly distributed across both the plate coupler 30 and block coupler 40.

In other embodiments not pictured herein, the arm 50 may be secured to the coupler 30, 40 using a different structure and/or method (or the same method with various elements differently configured), and the tool 10 is not limited by the structure and/or method for securing the arm 50 to the coupler 30, 40. Accordingly, any structure and/or method known to those skilled in the art suitable for securing one object to another may be used to secure the arm 50 to the coupler 30, 40 without limitation, including but not limited to screws, rivets, chemical adhesives, welds, and/or combinations thereof.

The interior surface of the connector tube 22 may be formed with threads thereon configured to engage threads formed on the end of the arm 50 opposite the handle 58. Accordingly, the arm 50 may be secured to the connector 20 (and consequently the coupler 30, 40) via engagement of the threads in the connector tube 22 with the threads formed on the arm 50. However, in other embodiments not pictured herein, the arm 50 may be secured to the connector 20 using a different structure and/or method, and the tool 10 is not limited by the structure and/or method for securing the arm 50 to the connector 20. Accordingly, any structure and/or method known to those skilled in the art suitable for securing one object to another may be used to secure the arm 50 to the connector without limitation, including but not limited to screws, rivets, chemical adhesives, welds, and/or combinations thereof.

The threaded interior of the connector tube 22 may be made accessible from both ends of the connector tube 22 to facilitate simple conversion of the tool 10 from the plate coupler 30 to the block coupler 40 and vice versa. Accordingly, to convert the tool 10 from the plate coupler 30 to the block coupler 40, the operator simply unscrews the connector engagement member 52 of the arm 50 from the end connector tube 22 adjacent the block coupler 40 and screws the connector engagement member 52 of the arm 50 into the end of the connector tube 22 adjacent the plate coupler 30.

Figure 5:
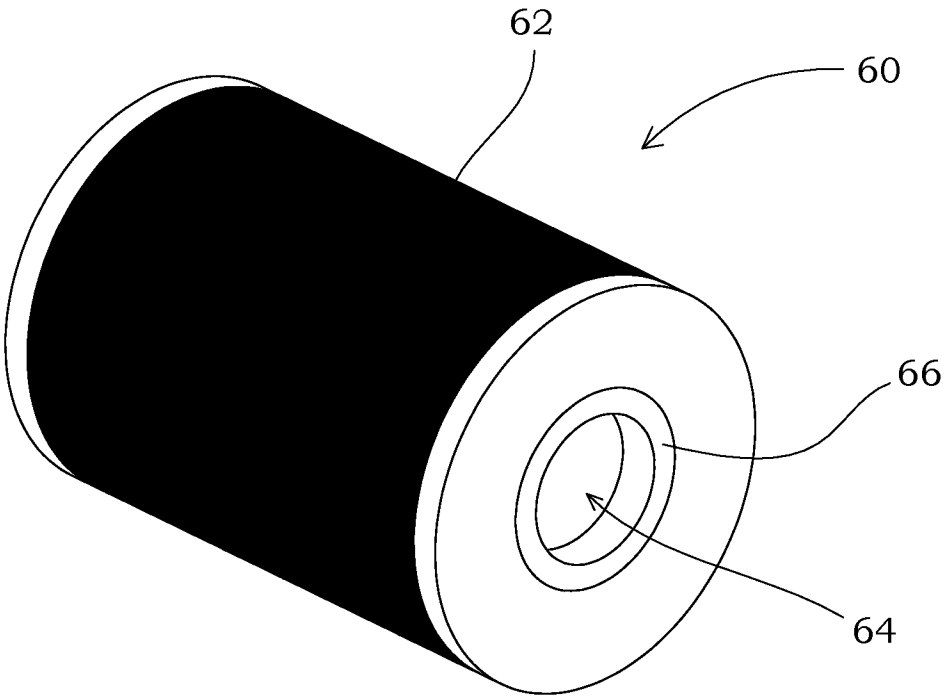
FIG. 5 is a perspective view of one embodiment of a weight.

A weight 60, which is shown in detail in FIG. 5, may be positioned to slidably engage a portion of the arm 50. The weight may be configured with an arm aperture 64 in the center thereof, through which the arm 50 may pass. The weight 60 may be configured to slide along the arm 50 from a position adjacent the coupler 30, 40 to a position adjacent the handle 58. The weight 60 may be configured with a grip 62 on the exterior thereof for aiding the user in grasping the weight 60. A sleeve 66 may be positioned in the arm aperture 64to serve as a bearing between the weight 60 and the arm 50. The optimal mass for the weight 60 will vary from one embodiment of the tool 10 to the next, as will the optimal length of the stroke 54. It is contemplated that for most applications the mass of the weight 60 will be from two pounds to twenty pounds, and the length of the stroke 54 will be from six inches to thirty inches. However, these sizes are for illustrative purposes only, and certain embodiments of the tool 10 may fall outside these parameters. Furthermore, the weight 60 as shown herein is generally cylindrical in shape. However, the weight 60 may have any shape that is desirable for the particular application of the tool 10, and therefore the scope of the tool 10 as disclosed and claimed herein is not limited by the shape and/or configuration of the weight 60.

The embodiment of the tool 10 pictured herein is specifically designed for use with Sikorsky H-60, S-70, S-76, S-92 and various other European- and/or Asian-specific models or variations thereof. However, the tool 10 may be configured for use with other machinery. For example, in one embodiment of the tool 10 not pictured herein, the plate coupler 30 may be configured to directly engage the outboard face of an elastomeric bearing 80. It is contemplated that such an embodiment would be especially useful for machinery in which the spindle 70 may be removed from a hub 18 prior to removing the bearing 80 from the same hub 18.

2. Description of One Method of Use

One method for using the embodiment of the tool 10 pictured herein with a Sikorsky Black Hawk or Sea Hawk aircraft will now be described. After the main rotor blades (not shown) have been removed and the associated hydraulics, electronics and other control systems have been disconnected, and after the bolts securing the bearing bolt plate 80 to the hub 18 have been removed, the coupler 30, 40 may be secured to the spindle 70 via the blade engagement portion 72 of the spindle 70.

Figure 6:
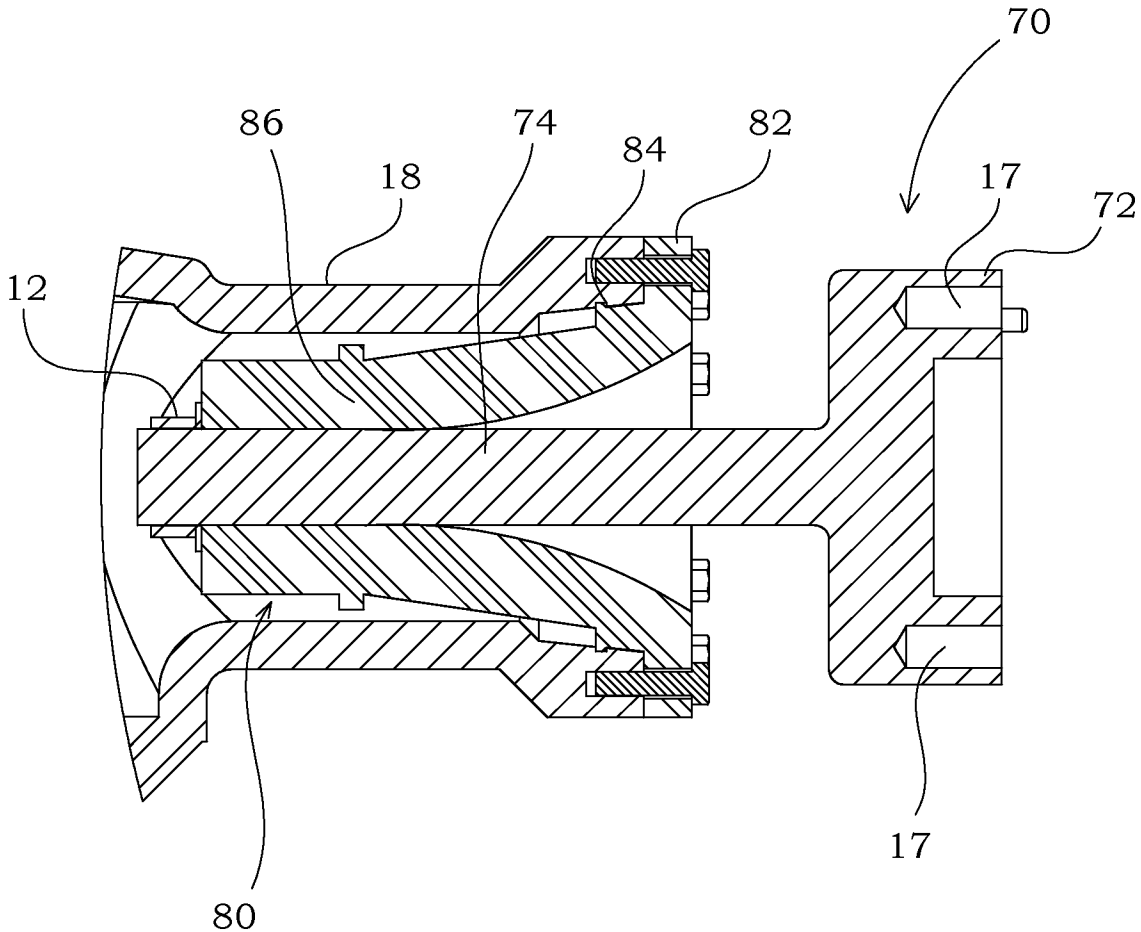
FIG. 6 is a simplified cross-sectional view of a first embodiment of a spindle, bearing, and hub assembly.
Figure 7:
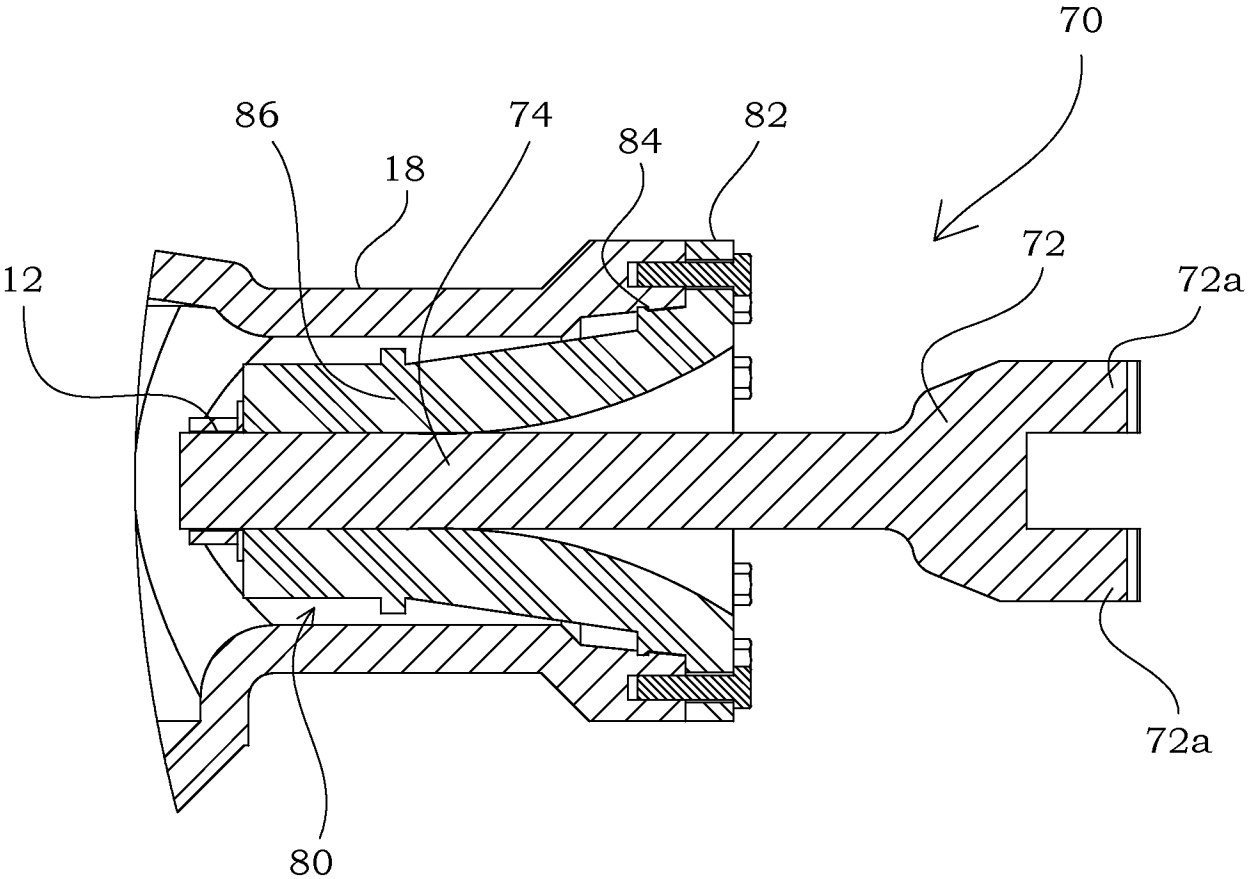
FIG. 7 is a simplified cross-sectional view of a second embodiment of a spindle, bearing, and hub assembly.

FIG. 6 shows a simplified cross-sectional view of one embodiment of a hub 18, spindle 70, and bearing 80, such as may be found on the Sikorsky S-70 helicopter. As shown, and as is well known to those skilled in the art, the bearing bolt plate 82 abuts the end of the hub 18 and the shoulder 84 abuts the interior surface of the hub 18 when the bearing 80 is installed in the hub 18. The shaft 74 of the spindle 70 extends through the bearing body 86, both of which are positioned within the interior of the hub 18 when installed. The bearing 80 is secured to the spindle 70 via a nut 12 positioned on the end of the spindle 70. FIG. 7 shows a similar simplified cross-sectional view of a hub 18, spindle 70, and bearing 80 such as may be found on the Sikorsky H-60 helicopter. The hub 18, spindle 70, and bearing 80 will not be further described herein for purposes of clarity. Additionally, the hub 18, spindle 70, and bearing 80 depicted in FIGS. 6 and 7 are for illustrative purposes only, and the tool 10 is not limited in scope to the type of hub 18, spindle 70, and/or bearing 80 on which the tool 10 operates. Accordingly, the tool 10 may be used with hub 18, spindle 70, and/or bearing 80 elements that are different from those depicted herein.

Figure 6A:
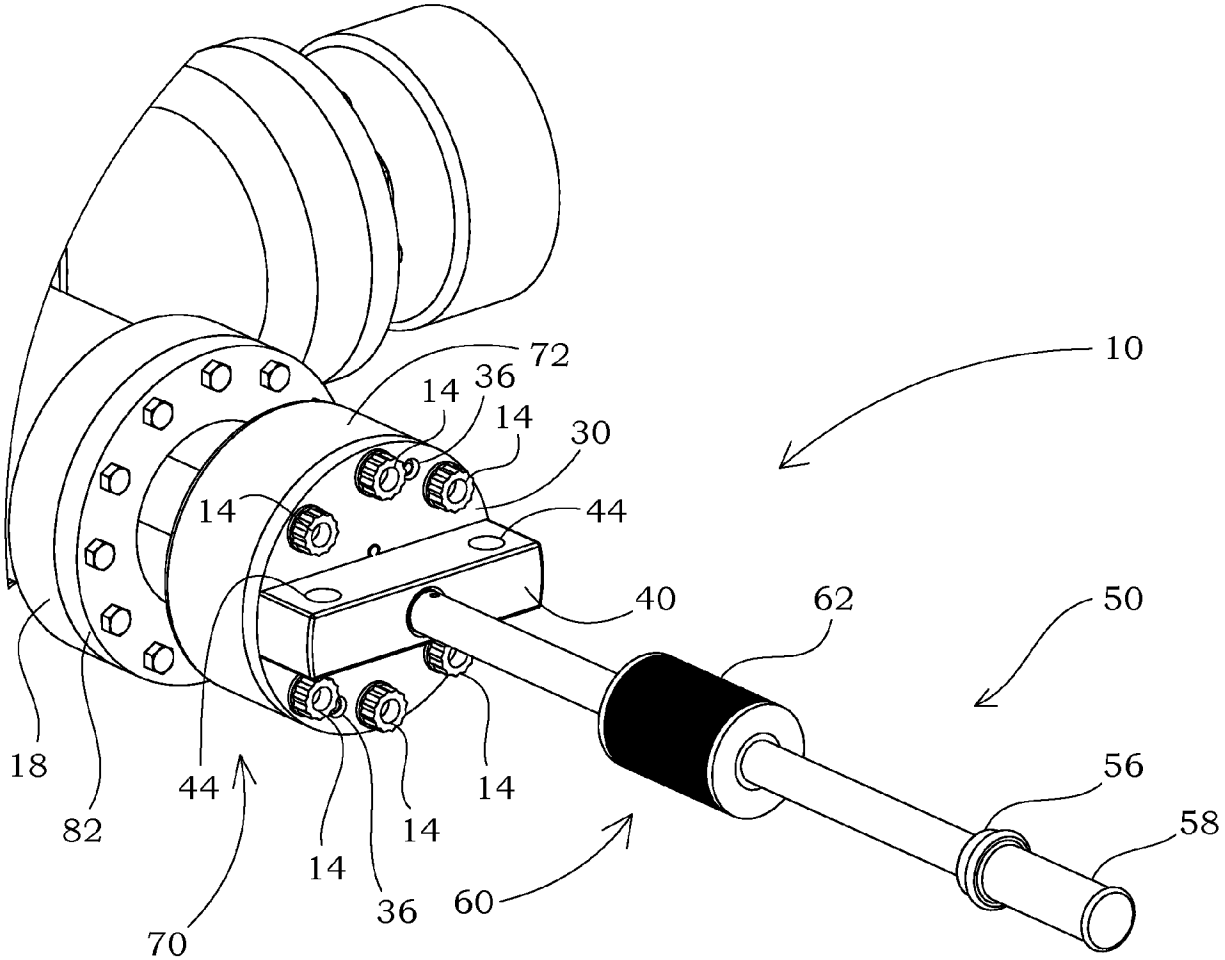
FIG. 6A is a perspective view of one embodiment of the tool the first embodiment of a spindle via a plurality of bolts.

FIG. 6A shows the plate coupler 30 engaged with a bolt-on type of spindle 70, such as that employed on the Sikorsky S-70 helicopter. To secure the plate coupler 30 to a spindle 70 with a blade engagement portion 72 such as this, six bolts 14 are placed through the six plate apertures 34 and into threaded apertures 17 in the blade engagement portion 72 of the spindle 70. The plate coupler 30 is oriented so that the block coupler 40 is facing away from the spindle 70.

Figure 7A:
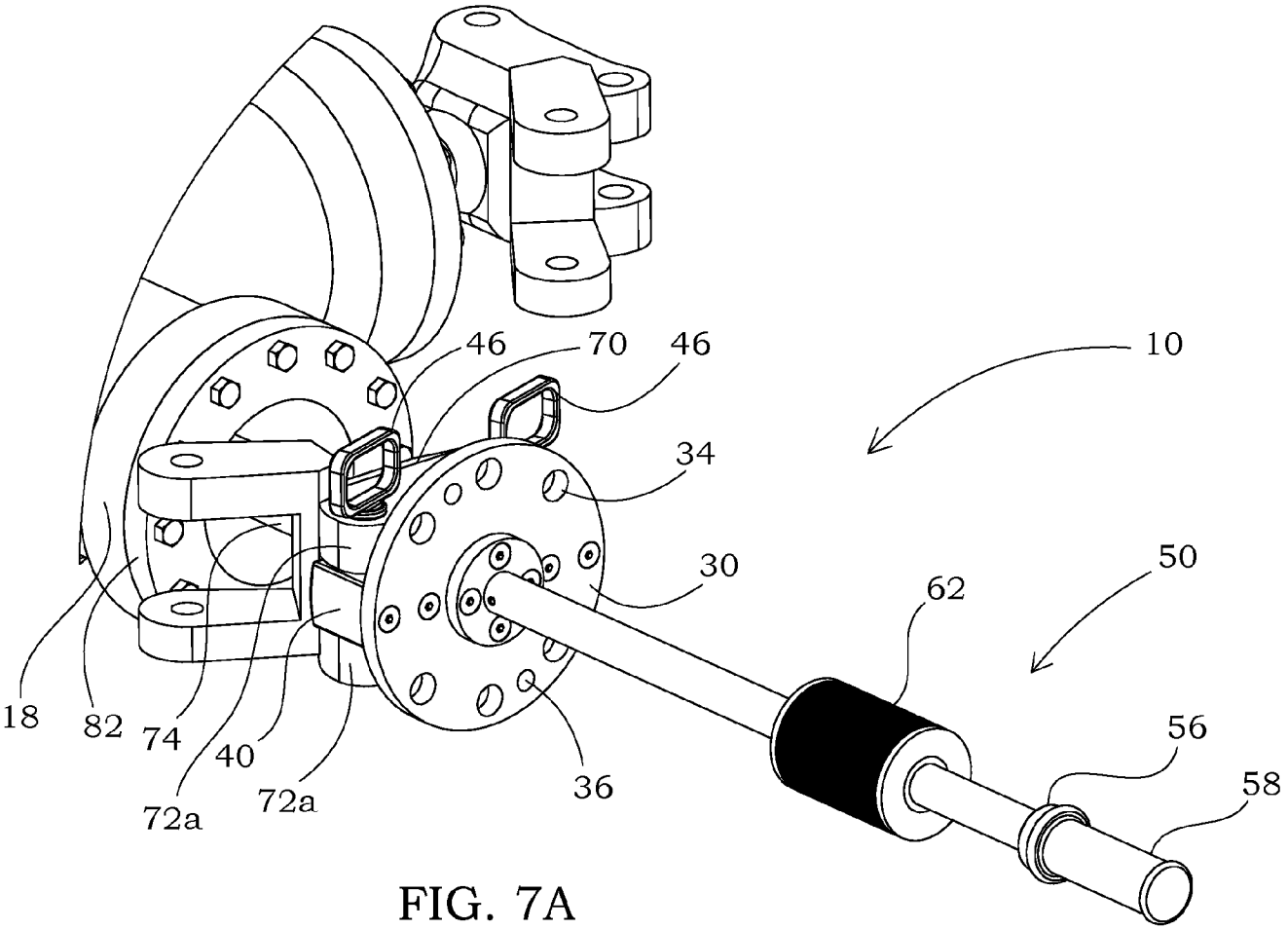
FIG. 7A is a perspective view of one embodiment of the tool the second embodiment of a spindle via a plurality of pins.

FIG. 7A shows the block coupler 40 engaged with a pin-on type of spindle 70, such as that employed on the Sikorsky H-60 helicopter. To secure the block coupler 40 to a spindle 70 with a blade engagement portion 72 such as this, the block coupler 40 is positioned between the two spindle arms 72*a* of the blade engagement portion 72. Two pins 46 are placed through the two pin apertures 44 in the block coupler 40, which two pin apertures 44 correspond to apertures formed in the spindle arms 72*a* of the blade engagement portion 72. The block coupler 40 is oriented so that the plate coupler 30 is facing away from the spindle 70.

After the coupler 30, 40 is sufficiently secured to the spindle 70, the weight 60 may be slid over the connector engagement member 52 and onto the arm 50. The arm 50 may then be secured to the coupler 30, 40 by engaging the threads of the connector engagement member 52 with the threads on the interior of the connector tube 22.

To remove the spindle 70, the operator may slide the weight 50 along the stroke 54 from a first position adjacent the coupler 30, 40 to a second position adjacent the handle 58. Once the weight 50 reaches its outboard limit of travel, the kinetic energy of the weight 50 is transferred to the tool 10, and consequently to the spindle 70 and bearing. The weight 50 may be returned to the first position and again moved to the second position to provide a force in the outboard direction (i.e., away from the center of the hub 18). This tool 10, when used in this manner, allows the operator to dictate the amount of force transmitted to the spindle 70 from the weight 50 by adjusting the mass and/or speed of the weight 50 when it approaches the limit of travel at the second position.

The procedure for installing a spindle 70 using the embodiment of the tool 10 pictured herein is a corollary to the removal thereof. However, when installing a spindle 70 the energy transfer from the weight 50 to the spindle 70 occurs when the weight 50 is moved from the second position (adjacent the handle 58) to the first position (adjacent the coupler 30, 40). In this manner, the movement of the weight 50 provides a force in the inboard direction (i.e., toward the center of the hub 18).

The various elements of the aircraft in both FIGS. 6 and 7 have been simplified for purposes of clarity, and other steps may be required for spindle and/or bearing removal and/or assembly based on the specific design of the bearing 80, spindle 70, and/or hub 18. Accordingly, other methods of using the tool 10 will become apparent to those skilled in the art in light of the present disclosure. For example, it is contemplated that in some applications it will be desirable to use a percussive hammer in addition to or in lieu of the weight 60. The methods and embodiments pictured and described herein are for illustrative purposes only. The tool 10 may also be configured to mount directly to a bearing bolt plate 80 or other part of a bearing. Additionally, the tool 10 may be configured to mount to spindles 70 having a blade engagement portion 72 other than the bolt-on or pin-on types as disclosed and pictured herein.

The tool 10 and various elements thereof may be constructed of any suitable material known to those skilled in the art. It is contemplated that in the embodiment as pictured herein, the connector 20, coupler 30, 40, arm 50, and weight 60 will be constructed of a metal or metallic alloy, but other embodiments may be constructed of other materials, such as polymers, other non-metallic materials, or any combinations thereof. It is also contemplated that in the embodiment of the tool 10 as pictured herein, the handle 58 and/or sleeve 66 will be constructed of a friction-reducing material, such as Teflon®, or any other suitable material known to those skilled in the art. In certain applications of the tool 10 it may be desirable to have the contacting surfaces be intrinsically safe and constructing of non-sparking materials, such as bronze. Accordingly, various components of the tool 10, such as the connector 20, coupler 30, 40, arm 50, limiter 56 (if so equipped) and/or weight 60 may be plated with a non-sparking material or constructed entirely therefrom.

It is contemplated that the tool 10 may be packaged as a kit having multiple couplers 30, 40, arms 50, and/or weights 60. For example, the tool 10 may be packaged with one plate coupler 30 having a diameter of six inches, one plate coupler 30 having a diameter of eight inches, one block coupler 40 having a major length of six inches, one arm 50 having a length of twenty inches, one arm having a length of thirty inches, one weight 60 having a mass of seven pounds, and one weight 60 having a mass of ten pounds. However, the specific dimensions and/or configuration of any couplers 30, 40, arms 50, and/or weights 60 included in such a kit are in no way limiting to the scope of the tool 10 as disclosed and claimed herein. Furthermore, those specific dimensions and/or configuration are also not limiting to the scope of the kit.

It should be noted that the tool 10 is not limited to the specific embodiments pictured and described herein, but is intended to apply to all similar apparatuses and methods for removing a spindle 70 and/or bearing from a hub 18. Modifications and alterations from the described embodiments will occur to those skilled in the art without departure from the spirit and scope of the present invention.

Furthermore, modifications and alterations from the described embodiments will occur to those skilled in the art without departure from the spirit and scope of any method of use of the present invention. While certain methods have been described in connection with specific embodiments thereof, it will be understood that it is capable of further modifications, and this application is intended to cover any variations, uses, or adaptations of the method following, in general, the principles of the method and including such departures from the present disclosure as come within known or customary practice within the art to which the method pertains and as may be applied to the essential features herein before set forth, and as follows in the scope of the appended claims.

What is claimed is:

1. A tool comprising:

a. a coupler configured for engagement with a structure affixed to an elastomeric bearing, wherein said coupler is a plate coupler formed with a plurality of plate apertures therein, and wherein said plurality of pin apertures is defined as including two said pin apertures, and wherein the distance between the center of said two pin apertures is eight inches;

b. an arm secured to said coupler at a first end of said arm;

c. a handle secured to said arm at a second end of said arm; and d. a weight slidably engaged with said arm between said coupler and said handle.

2. The tool according to claim 1 wherein a distance said weight may travel along said arm is defined as a stroke, and where said stroke is thirty inches long.

3. The tool according to claim 1 further comprising a limiter, wherein said limiter is positioned adjacent said handle, and wherein said limiter is configured such that said limiter prevents said weight from moving along said arm beyond said limiter in an outboard direction.

4. The tool according to claim 1 wherein said weight further comprises an arm aperture formed in the center thereof such that said arm passes through said arm aperture.

5. The tool according to claim 4 further comprising a sleeve, wherein said sleeve is positioned in said arm aperture.

6. The tool according to claim 5 further comprising a connector, wherein said coupler is further defined as being secured to said arm via said connector.

7. The tool according to claim 6 wherein said weight is further defined as having a mass of ten pounds.

* * * * *